US005978628A

United States Patent [19]

Rees

[11] Patent Number: 5,978,628

[45] Date of Patent: Nov. 2, 1999

[54] HIGHLIGHT COLOR READ PRINTING USING ADDITIVE TONERS

[75] Inventor: James D. Rees, Pittsford, N.Y.

[73] Assignee: Xerox Corporation, Stamford, Conn.

[21] Appl. No.: 09/205,979

[22] Filed: Dec. 4, 1998

[51] Int. Cl.[6] ..... G03G 15/01

[52] U.S. Cl. ..... 399/178; 347/115; 399/223

[58] Field of Search ..... 399/223, 134, 399/178; 347/115

[56] References Cited

U.S. PATENT DOCUMENTS

| | | | |
|---|---|---|---|
| 4,661,703 | 4/1987 | Ishikawa et al. | 250/317.1 |
| 5,023,632 | 6/1991 | Yamamoto et al. | 347/119 |
| 5,032,852 | 7/1991 | Fujii et al. | 347/118 |
| 5,045,420 | 9/1991 | Hosono et al. | 399/178 X |
| 5,053,821 | 10/1991 | Kunugi et al. | 399/134 |
| 5,184,146 | 2/1993 | Tanaka et al. | 347/232 |
| 5,208,796 | 5/1993 | Wong et al. | 250/548 X |
| 5,252,995 | 10/1993 | Trask et al. | 347/119 |
| 5,272,493 | 12/1993 | Hubble, III et al. | 347/116 |
| 5,386,223 | 1/1995 | Saitoh et al. | 347/115 X |
| 5,418,097 | 5/1995 | Furuya et al. | 399/223 X |
| 5,438,401 | 8/1995 | Murayama et al. | 399/228 |
| 5,515,155 | 5/1996 | Folkins | 399/223 |
| 5,537,198 | 7/1996 | Jackson | 399/168 |
| 5,581,330 | 12/1996 | Pietrowski et al. | 399/171 |
| 5,600,430 | 2/1997 | Folkins et al. | 399/171 |
| 5,752,137 | 5/1998 | Haneda | 399/223 |
| 5,828,933 | 10/1998 | Rees et al. | 399/223 |

OTHER PUBLICATIONS

Japan Patent Office (JP) 3–202869, Color Image Forming Apparatus, Sep. 1991 15 pages.

*Primary Examiner*—Susan S. Y. Lee
*Attorney, Agent, or Firm*—John M Kelly

[57] ABSTRACT

REaD electrophotographic printing using additive color toners. Toners that are non-transmissive to exposing light are developed using inhibited image-on-image printing. Then, the photoreceptor is exposed to produce a latent image for a toner that transmits the exposing light. Finally, the latent image for a toner that transmits the exposing light is developed.

10 Claims, 1 Drawing Sheet

HIGHLIGHT COLOR READ PRINTING USING ADDITIVE TONERS

FIELD OF THE INVENTION

This invention relates to electrophotographic color printers that use inhibited image-on-image technology. In particular, this invention relates to such printers that utilize additive toners and visible or very near infrared wavelengths.

BACKGROUND OF THE INVENTION

Electrophotographic marking is a well-known, commonly used method of copying or printing documents. Electrophotographic marking is performed by exposing a charged photoreceptor with a light image representation of a desired document. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate, such as a sheet of paper. The transferred toner image is then fused to the substrate, usually using heat and/or pressure, thereby creating a permanent image. The surface of the photoreceptor is then cleaned of residual developing material and recharged in preparation for the production of another image.

The foregoing broadly describes a prototypical black and white electrophotographic printer. Electrophotographic marking can also produce color images by repeating the above process once for each color of toner that is used to make a final color image. For example, in the REaD IOI process (Recharge, Expose, and Develop, Image On Image), a charged photoreceptor is exposed to a light image which represents a first color image, say black. The resulting electrostatic latent image is then developed with black toner to produce a black toner image. The charge, expose, and develop process is then repeated for a second color (say yellow), and then possibly for a third color (say magenta) and a fourth color (say cyan). If the various colors of toner particles are suitably registered a desired composite color image results. However, if the toner layers are not placed in a superimposed registration, but are rather placed in discrete areas, a highlight image results. Highlight color machines typically use at least black and an additive toner such as red. For example, most of a bill might be printed in black, but the payment due might be printed in red so as to stand out from the rest of the bill. In any event, the final image is then transferred and fused onto a substrate.

The REaD IOI electrophotographic printing process described above is usually performed in a machine in which "subtractive" color toners, usually cyan, magenta, and yellow, are overlaid to result in a final image having various colors and color tones. Subtractive colors absorb one third of the visible spectrum. While this process, referred to hereinafter as image-on-image color printing is very useful when producing image pictorials, image-on-image color printing is not optimum for highlight color printing. In highlight color printing a highly saturated color, such as deep red, is usually desired. Unfortunately, image-on-image color printing is inefficient when producing colors such as deep red because subtractive toners are usually not able to produce the desired color hue and chroma.

Red, green, and blue are "additive" colors. Additive colors absorb two thirds of the visible spectrum. For this reason they are unsuitable for image-on-image color printing because placing two colors of toner on top of each other results in black (or dark brown). Thus additive color toners cannot be used in image-on-image color REaD IOI printing. Thus with additive color toners it is very important to suppress, rather than to enhance image-on-image (IOI) development.

U.S. Pat. No. 5,828,933, which issued on OCT. 27, 1998 entitled "ADDITIVE COLOR RECHARGE, EXPOSE, AND DEVELOP ELECTROPHOTOGRAPHIC PRINTING" teaches how to perform additive color REaD printing. That patent discloses three basic ways of inhibiting image-on-image printing. First, by setting the exposure set point (threshold) such that exposure losses when imaging through an existing toner layer reduces the electrostatic developing potential such that toner is only deposited on "bare" (no toner) areas of a photoreceptor. Second, by using a DC corona system (such as a DC scorotron) for recharging so as to enhance the voltage drop across previously developed toner. Third, by increasing the developed toner mass so as to increase the dielectric properties of developed toner. However, this process is somewhat complicated and difficult to implement.

Therefore, an alternative technique of achieving inhibited image-on-image REaD printing when using additive toners would be beneficial.

SUMMARY OF THE INVENTION

The principles of the present invention provide for inhibited image-on-image REaD printing when using additive toners. The present invention is particularly useful when using visible or very near infrared exposing light. The invention includes first developing toner or toners that are non-transmissive to the exposing light using inhibited image-on-image printing. Then, exposing the photoreceptor for a color of toner that transmits the exposing light. Finally, developing the toner that transmits the exposing light.

BRIEF DESCRIPTION OF THE DRAWINGS

Other aspects of the present invention will become apparent as the following description proceeds and upon reference to FIG. 1, which shows an electrophotographic printing machine that incorporates the principles of the present invention.

DETAILED DESCRIPTION OF A PREFERRED EMBODIMENT OF THE INVENTION

Figure 1:
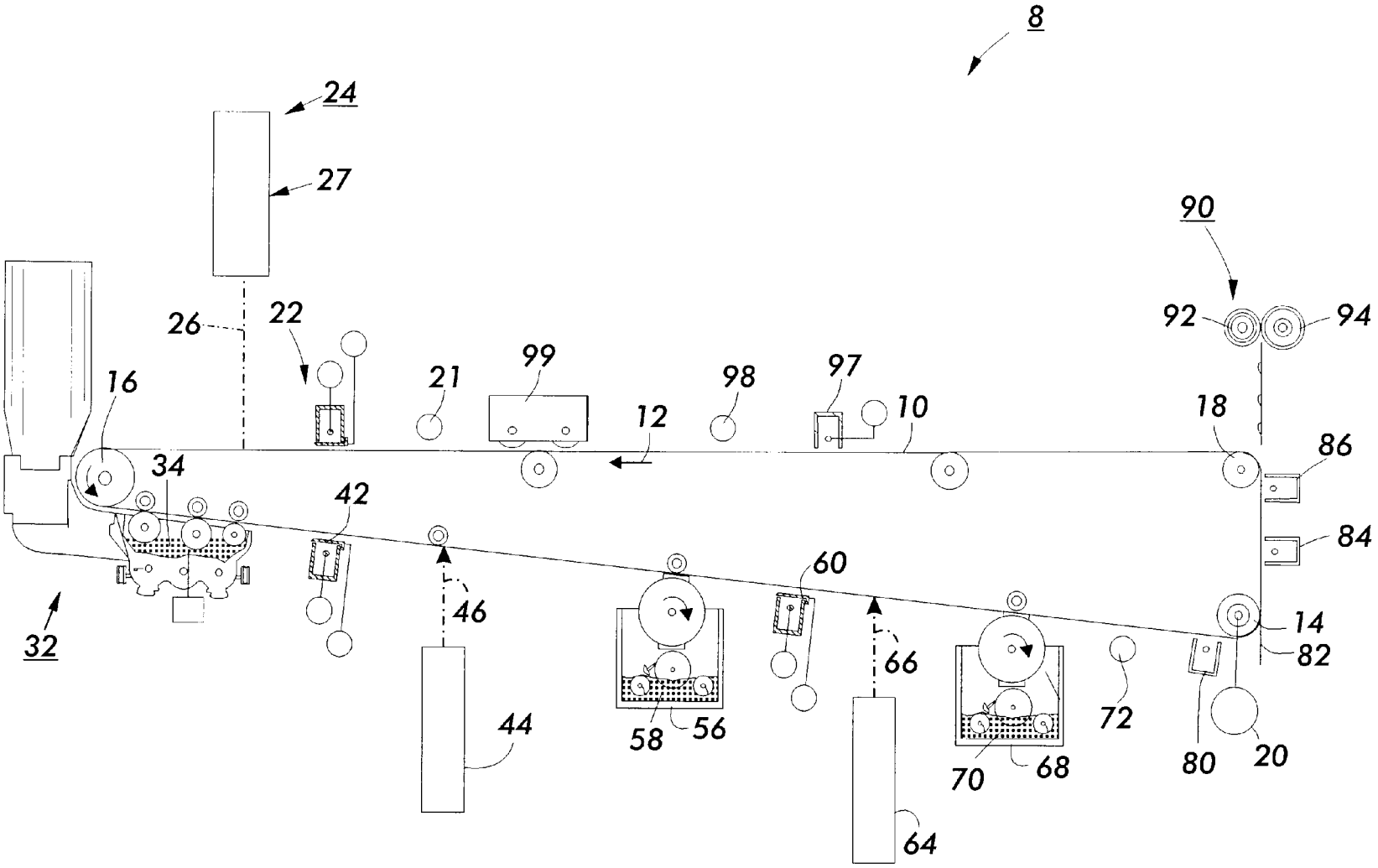

Refer now to FIG. 1 wherein a preferred embodiment of the present invention is implemented in a black plus two highlight color electrophotographic printing machine 8 which beneficially uses additive color toners. While the printing machine 8 includes a plurality of individual subsystems that are known in the art, they are implemented in a new, non-obvious, and useful way.

The printing machine 8 includes an Active Matrix (AMAT) photoreceptor belt 10 which travels in the direction indicated by the arrow 12. The belt is mounted about a driven roller 14 and tension rollers 16 and 18. The driven roller 14 is then rotated by a motor 20, causing the belt to travel in the direction 12.

As the photoreceptor belt travels each part of it passes through each of the subsequently described process stations. For convenience, a single section of the photoreceptor belt, referred to as the image area, is identified. The image area is that part of the photoreceptor belt which is to receive the various actions and toner layers that produce the final color image. While the photoreceptor belt may have numerous image areas, since each image area is processed in the same way a description of the processing of one image area suffices to explain the operation of the printing machine 8.

The imaging process begins with the image area passing a "precharge" erase lamp 21 that illuminates the image area so as to cause any residual charges which might exist on the image area to be discharged. Such erase lamps are common in high quality systems.

As the photoreceptor belt continues its travel the image area passes a charging station comprised of a DC corotron 22 that charges the image area in preparation for exposure to create a latent image. It should be understood that the actual charge placed on the photoreceptor depends upon many variables, such as the toner mass that is to be developed and the settings of the development stations (see below).

After passing through the charging station the image area advances until it reaches a first exposure station 24. At that exposure station the charged image area is exposed to a modulated laser beam 26 from a raster output scanner 27 that raster scans the image area such that an electrostatic latent representation of a black image is produced. Alternatively, an LED printbar might be used.

The laser beam 26 itself has a wavelength of 675 nanometers. Many currently available toners pass light at that wavelength with little attenuation. For example, a wavelength of 675 nanometers readily passes through commonly available red, yellow, and magenta toners. However, light at that wavelength does not pass through other colors of toner. For example, commonly available black, green, and cyan toners highly attenuate light at that wavelength.

After passing the exposure station 24 the now exposed image area with its black latent image passes a black development station 32. That station deposits black toner 34 onto the image area so as to develop the black latent image. Electrical biasing is such as to effect discharged area development (DAD). While the black development station 32 could be a magnetic brush developer as shown in FIG. 1, a scavengeless developer may actually be somewhat better, primarily because subsequent developers must use a non-contacting developer, such as a scavengeless developer. It is simply easier to produce a printing machine with a smaller number of different parts.

After passing the black development station 32 a DC scorotron 42 recharges the image area and its black toner layer. The recharged image area with its black toner layer then advances to an exposure station 44, which is similar to the black exposure station 24. The exposure station 44 exposes the image area with a laser beam 46 so as to produce an electrostatic latent representation of a green image. The laser beam 46 also has a wavelength of 675 nanometers and is therefore highly attenuated as it attempts to pass through the black toner 34.

After passing the exposure station 44 the now re-exposed image area advances past a green development station 56 that deposits green toner 58 onto the image area. Since a layer of black toner may already exist on the image area, the green development station is beneficially a scavengeless developer. Since the black toner blocked the exposing laser beam 46, no area under the black toner is discharged. Thus, the green toner is prevented from depositing over the black toner and inhibited image-on-image printing is achieved.

After passing the green development station 56 the image area is recharged by a DC scorotron 60. The recharged image area with its black and green toner layers then advances to an exposure station 64. That exposure station is very much like the exposure stations 24 and 44, except that the exposure station 64 exposes the image area to produce an electrostatic latent representation of a red image. Once again, the red exposure station exposes the image area using a laser beam 66 having a wavelength of 675 nanometers. That laser beam is therefore highly attenuated as it attempts to pass through the black toner layer and the green toner layer.

After passing the exposure station 64 the now re-exposed image area advances past a red development station 68 that deposits red toner 70 onto the image area. As previously mentioned, the exposure station exposes the image area using a laser beam 66 with a wavelength (675 nanometers) that readily passes through red toner. However, since the red toner is the last toner layer that is developed, this is of no importance when marking with only three toners. Therefore, by arranging the architecture of the printing machine 8 such that earlier developed toners significantly attenuate exposing light, the last developed toner can significantly transmit the exposing light while still using inhibited image-on-image printing. This architecture is highly useful when using red and/or near-infrared laser diodes.

After passing the red development station the final toner image is comprised of toner particles that have charge potentials that vary widely. Directly transferring such a toner image onto a substrate would result in a degraded final image. Therefore it is beneficial to prepare the composite color toner image for transfer.

To prepare for transfer a pretransfer erase lamp 72 discharges the image area to produce a relatively low charge level on the image area. The image area then passes a pretransfer DC corotron 80 that performs a pre-transfer charging function. The image area continues to advance in the direction 12 past the driven roller 14. A substrate 82 is then placed over the image area using a sheet feeder (which is not shown). As the image area and substrate continue their travel they pass a transfer corotron 84. That corotron applies positive ions onto back of the substrate 81. Those ions attract the negatively charged toner particles onto the substrate.

As the substrate continues its travel is passes a detack corotron 86. That corotron neutralizes some of the charge on the substrate to assist separation of the substrate from the photoreceptor 10. As the lip of the substrate 82 moves around the tension roller 18 the lip separates from the photoreceptor. The substrate is then directed into a fuser 90 where a heated fuser roller 92 and a pressure roller 94 create a nip through which the substrate 82 passes. The combination of pressure and heat at the nip causes the composite color toner image to fuse into the substrate. After fusing, a chute, not shown, guides the substrate to a catch tray, also not shown, for removal by an operator.

After the substrate 82 is separated from the photoreceptor belt 10 the image area continues its travel and passes a preclean corotron 97 that neutralizes most of the residual charges on the photoreceptor. The image area then passes a preclean erase lamp 98. That lamp neutralizes most of the charges remaining on the photoreceptor belt After passing the preclean erase lamp the residual toner and/or debris on the photoreceptor is removed at a cleaning station 99. The image area then passes once again to the precharge erase lamp 21 and the start of another cycle.

Using well known technology the various machine functions described above are generally managed and regulated by a controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiments that will remain within the principles of the present invention. For example, the present invention might be used with printing machine that uses laser beams of different, possibly multiple, wavelengths or different colors of toner. Furthermore, the present invention might be used with multiple pass printing or with printing machines that do not use highlight printing. Therefore, the present invention is to be limited only by the appended claims.

What is claimed:

1. A printing machine, comprising:

a photoreceptor having at least one image area;

a first charging station for charging said image area;

a first exposure station for exposing said image area with light having a first wavelength so as to produce a first latent image;

a developing station for depositing a first toner on said first latent image to form a first toner image;

a second charging station for recharging said image area;

a second exposure station for exposing said image area with light having a second wavelength so as to produce a second latent image, wherein said second wavelength is highly attenuated by said first toner image;

a second developing station for depositing a second toner on said second latent image to form a second toner image;

a last charging station for recharging said image area;

a last exposure station for exposing said image area with light having a last wavelength so as to produce a last latent image, wherein said last wavelength is highly attenuated by said first toner image and by said second toner image; and a last developing station for depositing a last toner on said last latent image to form a last toner image, wherein said last toner layer substantially transmits light having said last wavelength.

2. A printing machine according to claim 1, wherein said first toner image attenuates light at said second wavelength such that said second developing station is substantially inhibited from developing said second toner on said first toner image.

3. A printing machine according to claim 1, wherein said second toner image attenuates light at said last wavelength such that said last developing station is substantially inhibited from developing said last toner on said second toner image.

4. A printing machine according to claim 1, wherein said first toner image attenuates light at said last wavelength such that said last developing station is substantially inhibited from developing said last toner on said first toner image.

5. A printing machine according to claim 1, wherein said second wavelength and said last wavelength are substantially equal.

6. A printing machine according to claim 1, wherein said last wavelength is in the visible spectrum.

7. A printing machine according to claim 1, wherein said second wavelength is red.

8. A color printing machine according to claim 1, wherein said first toner image, said second toner image, and said last toner image are different colors.

9. A color printing machine according to claim 1, wherein said last toner image is red.

10. A printing machine according to claim 1, wherein said light having said first wavelength, said light having said second wavelength, and said light having said last wavelength all have the same wavelength.

* * * * *